US005899266A

United States Patent [19]

Szucs

[11] Patent Number: 5,899,266

[45] Date of Patent: May 4, 1999

[54] PROCESS FOR REDUCING PRESSURE WITHIN A LIQUID FILLED CONTAINER

[76] Inventor: Lajos Szucs, 4815 St. Paul Blvd., Rochester, N.Y. 14617

[21] Appl. No.: 08/966,259

[22] Filed: Nov. 7, 1997

Related U.S. Application Data

[63] Continuation-in-part of application No. 08/560,366, Nov. 17, 1995, abandoned.

[51] Int. Cl.[6] ..... F28B 1/00

[52] U.S. Cl. ..... 165/110; 165/51; 165/148; 123/41.27; 123/41.29; 123/41.54

[58] Field of Search ..... 165/71, 104.27, 165/104.32, 917, 110, 51, 112, 148; 123/41.54, 41.29, 41.42, 41.27

[56] References Cited

U.S. PATENT DOCUMENTS

| | | | |
|---|---|---|---|
| 1,184,198 | 5/1916 | Morison | 165/71 |
| 2,436,281 | 2/1948 | Bartlett et al. | 123/41.42 |
| 2,612,349 | 9/1952 | Lintern | 165/71 |
| 3,051,450 | 8/1962 | White et al. | 165/110 |
| 3,139,073 | 6/1964 | White et al. | 123/41.29 |
| 3,254,707 | 6/1966 | Ferguson | 165/110 |
| 4,006,775 | 2/1977 | Avrea | 165/51 |
| 4,480,598 | 11/1984 | Berrigan | 123/41.27 |

*Primary Examiner*—Ira S. Lazarus
*Assistant Examiner*—Christopher Atkinson
*Attorney, Agent, or Firm*—Howard J. Greenwald

[57] ABSTRACT

A process for reducing the pressure buildup in an automobile radiator which contains a bottom section, a radiator header, a multiplicity of tubes extending between the bottom section and the radiator header, and a heat expansion chamber disposed at least about 0.5 inches above the radiator header and connected to the radiator header by a conduit. In this process, hot fluid containing antifreeze at a temperature of at least about 200 degrees Fahrenheit is flowed through the radiator tube; but hot fluid flow into the heat expansion chamber is prevented. The heat expansion chamber is made from a material with a resistivity at 20 degrees Centigrade greater than about 6 microhoms-centimeters; and the material within the heat expansion chamber has a resistivity at 20 degrees Centigrade of from about 6 to about 40 microhms-centimeters.

11 Claims, 3 Drawing Sheets

PROCESS FOR REDUCING PRESSURE WITHIN A LIQUID FILLED CONTAINER

CROSS-REFERENCE TO RELATED PATENT APPLICATION

This application is a continuation-in-part of applicant's copending patent application U.S. Ser. No. 08/560,366, filed on Nov. 17, 1995, now abandoned.

FIELD OF THE INVENTION

A process for reducing the pressure buildup present in a liquid-filled container in which gas is flowed into a heat expansion chamber.

BACKGROUND OF THE INVENTION

Automobile radiators are well known to those skilled in the art. By way of illustration, reference may be had to U.S. Pat. Nos. 5,329,982, 5,279,157, 5,186,246, 5,181,554, 4,896,718, 4,343,353, 4,036,288, and the like. The disclosure of each of these United States patents is hereby incorporated by reference into this specification.

The normal automobile radiator, in use, experiences a substantial amount of pressure buildup and contact with hot liquid under pressure. Because of this exposure to high-temperature and pressure conditions, such radiators, and their components (such as, e.g., radiator hoses, gaskets), often fail.

It is an object of this invention to provide an improved radiator system with increased durability for both the radiator and its component parts. It is another object of this invention to provide a process for using this improved radiator system.

SUMMARY OF THE INVENTION

In accordance with this invention, there is provided a process for reducing the pressure buildup within a liquid-filled container where the liquid (coolant) is comprised of an antifreeze/water mixture (coolant). In this process, gas is caused to flow from the liquid-filled container to a heat expansion chamber disposed above the liquid filled container; the heat expansion chamber is preferably made of a steel or titanium material, and contains no liquid (coolant).

BRIEF DESCRIPTION OF THE DRAWINGS

The present invention will be more fully understood by reference to the following detailed description thereof, when read in conjunction with the attached drawing, wherein like reference numerals refer to like elements, and wherein.

DESCRIPTION OF THE PREFERRED EMBODIMENTS

Figure 1:
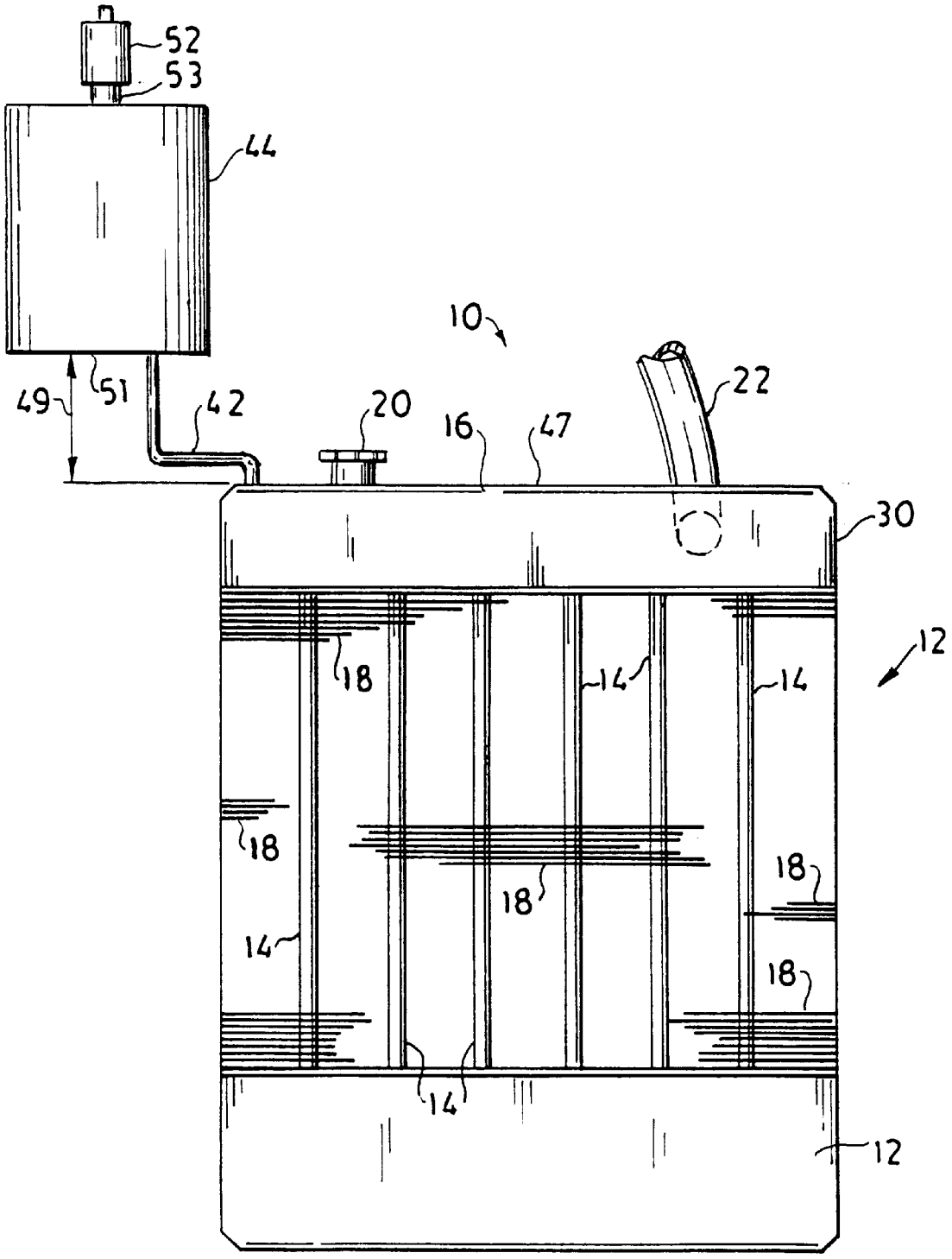
FIG. 1 is a front view of one embodiment of apparatus of this invention.

One preferred embodiment of the present invention is illustrated in FIG. 1. Referring to FIG. 1, it will be seen that radiator assembly 10 is preferably comprised of automobile radiator 12.

The preferred radiator 12 illustrated in FIG. 1 is comprised of a multiplicity of parallel tubes 14 which communicate with the top 16 of radiator header 30. Radiator header 30 is preferably comprised of a radiator header casing and a radiator header plate, and the radiator header plate is preferably formed with holes which are sealed to the tubes.

Referring again to FIG. 1, and in the preferred embodiment illustrated therein, it will be seen that radiator 10 also comprises a multiplicity of radiator fins 18. A removable radiator cap 20 allows one to add fluid to the radiator. Fluid also flows into radiator 10 by means of radiator hose 22.

As will be apparent to those skilled in the art, the radiator also contains a radiator header 30, radiator outlet (not shown) through which fluid may be returned to the engine block, a draincock (not shown) for draining radiator fluid, etc. These conventional structural features have been omitted from FIG. 1 for the sake of simplicity of representation.

As is known to those skilled in the art, the term "radiator" refers to a heating device for the circulation of steam or hot water; and it also refers to a cooling device, as in an automobile engine.

Although FIG. 1 illustrates one preferred embodiment of the invention, it will be apparent that it can be used in conjunction with other radiator configurations, such as those disclosed in the United States patents discussed below.

U.S. Pat. No. 5,337,704 discloses an engine cooling system with a thermostat coolant flow control disposed between its head and block. U.S. Pat. No. 5,329,982 discloses an internal combustion engine coolant extractor/injector with a coupling, which comprises a tank assembly, an air pressure control assembly, and a hose assembly. U.S. Pat. No. 5,279,157 discloses a liquid level monitor for sensing the level of liquid in a tank or vessel, such as an automobile radiator; the device employs a probe with a light-emitting diode and a phototransistor mounted inside the enclosure. U.S. Pat. No. 5,275,321 discloses a cooling system for an automotive engine comprised of a bypass valve and two bypass passages. U.S. Pat. No. 5,186,246 discloses a combination radiator and condenser apparatus which has a pair of tank and header assemblies adapted to connected in both a coolant system for liquid cooled engines and a refrigeration system of an automobile air conditioning system. U.S. Pat. No. 5,186,245 discloses an automotive radiator which has a tank containing a transmission oil cooler which has a double walled tubular configuration for heat transfer. U.S. Pat. No. 5,181,554 discloses a radiator cooling apparatus for an automobile internal engine which contains an air suction duct or air injection duct connected to a closed-type blower. U.S. Pat. No. 5,167,294 discloses an auxiliary liquid cooling system for snowmobiles consisting of a small automotive type of radiator mounted along one or both sides of the snowmobile drive tunnel; the engine cooling liquid flows through the radiators in addition to the factory heat exchangers. U.S. Pat. No. 5,139,080 discloses an assembly for mounting an automotive condenser to a radiator. U.S. Pat. No. 5,052,571 discloses an automotive radiator cap. U.S. Pat. No. 4,941,437 discloses an automotive radiator cooling system. U.S. Pat. No. 4,896,718 discloses a water reservoir device containing an oil exchanger. U.S. Pat. No. 4,809,773 discloses an automotive radiator. U.S. Pat. No. 4,612,977 discloses a drain device of an automotive radiator. U.S. Pat. No. 4,558,819 discloses an automatic valve closer to prevent tampering with a thermostatic controlled radiator. U.S. Pat. No. 4,492,602 discloses the use of copper based alloys for automotive radiator fins. U.S. Pat. No. 4,343,353 discloses an automobile radiator filter. U.S. Pat. No. 4,191,327 discloses an automatic thermostatic control for a steam trap radiator. The entire disclosure of each and every one of these United States patents is hereby incorporated by reference into this specification.

By way of further illustration and not limitation, some additional suitable radiators are disclosed in U.S. Pat. Nos. 5,358,178, 5,356,337 (cooling radiator for traction motor), U.S. Pat. Nos. 5,353,751, 5,348,082 (heat exchanger radiator), U.S. Pat. Nos. 5,346,003, 5,343,717, 5,341,455 (oil radiator), U.S. Pat. Nos. 5,339,775, 5,333,679, 5,332,030 (radiator for a spacecraft), U.S. Pat. No. 5,332,239 (radiator board formed with a plurality of radiating fins), U.S. Pat. Nos. 5,329,982, 5,320,190, 5,320,165 (radiator core including spaced parallel tubes with fins extending between adjacent tubes), U.S. Pat. Nos. 5,318,700, 5,318,113 (radiator with a bundle of parallel tubes and a header plate formed with holes), U.S. Pat. No. 5,316,872 (flat, hollow radiator), U.S. Pat. No. 5,311,934 (radiator with a bundle of finned tubes open into a header comprised of a header casing and a header plate), U.S. Pat. No. 5,309,889 (radiator fan), U.S. Pat. No. 5,306,430 (radiator having a by-pass outlet), U.S. Pat. No. 5,304,280 (radiator header plate), U.S. Pat. No. 5,301,748 (radiator header plate with holes), U.S. Pat. No. 5,289,874 (radiator with louvered fin section), U.S. Pat. No. 5,281,331 (radiator fluid filter), U.S. Pat. No. 5,279,025 (radiator cap assembly), U.S. Pat. No. 5,277,227 (sleeve for radiator hose), U.S. Pat. No. 5,267,606 (radiator drain pipe), U.S. Pat. No. 5,246,202 (drain cock for radiator tank), U.S. Pat. No. 5,233,246 (radiator plate), U.S. Pat. No. 5,230,610 (radiator fan), U.S. Pat. Nos. 5,226,592, 5,226,235 (radiator core), U.S. Pat. No. 5,219,022 (radiator with header tank and bottom tank connected by a core), U.S. Pat. Nos. 5,219,016, 4,741,394, 4,741,392 (sectional core radiator), U.S. Pat. Nos. 4,738,306, 4,714,408 (radiator fan), U.S. Pat. No. 4,458,749, 4,427,875 (steam radiator), U.S. Pat. Nos. 4,397,348 (radiator baffle), U.S. Pat. No. 4,066,122 (multilayer plastic radiator), U.S. Pat. No. 4,041,594 (brazed core radiator), and the like. The disclosure of each of these United States patents is hereby incorporated by reference into this specification.

Referring again to FIG. 1, and in the preferred process depicted therein, hot gas passes from radiator header 30 through tube 42 to expansion chamber 44.

Tube 42 can be made out of any material conventionally used for such tubes in automobiles. Thus, e.g., tube 42 may be made out of rubber other elastomeric material, copper, plastic, etc. In one preferred embodiment, tube 42 is preferably made from either copper, brass, or aluminum.

Tube 42 preferably has a substantially cylindrical shape with an inner diameter of from about 0.1 to 0.5 inches.

Tube 42 communicates with radiator header 30, and also with heat expansion chamber 44. The expansion chamber preferably is made out of a material with a resistivity at 20 degrees Centigrade, expressed in microhms-centimeters, greater than about 6, preferably from about 6 to about 20 and, more preferably, from about 8 to about 20. Thus, by way of illustration and not limitation, one may use tin-plated steel, plated steel, stainless steel, and the like.

Not only must the heat expansion chamber 44 be made out of a specified material with a specified resistivity, but also the material within said heat expansion chamber must also have a specified resistivity.

In general, the material within heat expansion chamber 44 is preferably air, which has a resistivity substantially higher than 6 microhms-centimeters (about 39.5 microhms-centimeters). When material other than air is present within the expansion chamber 44, the average resistivity of the material within the expansion chamber should preferably be higher than 6 microhms-centimeters but less than 40 microhms-centimeters. Although applicant does not wish to be bound to any particular theory, he has found that when heat-expansion chamber 44 contains a substantial amount of liquid, or a substantial amount of number 12 copper wire (75 feet in volume of one quart), the system does not work.

In one embodiment, illustrated in FIG. 1, the heat expansion chamber 44 has a substantially cylindrical shape; the ratio of the diameter of the cylindrical chamber to its height ranges from about 0.8/1 to about 5.0/1. In another embodiment, not shown, a rectangular container which has a length of about 14.5 inches and a height of 2.0 inches, and a width of 2.0 inches, may be used.

In general, the size of the heat expansion chamber 44 is dependent on the volume of the liquid within radiator 12. In one embodiment, when the fluid within radiator 12 is about 2.0 gallons, the size of the heat expansion chamber is about 1 quart. It is preferred that the size of the heat expansion chamber 44, be from about 10 percent to about 20 percent of the volume of the fluid within radiator 12. In one embodiment, expansion chamber 14 has a volume of from about 0.5 to about 1.0 gallons.

In one preferred embodiment, the fluid within radiator 12 is a mixture of water and antifreeze (coolant). One may use any of the conventional glycol based antifreeze (coolant) compositions such as, e.g., those described in one or more of U.S. Pat Nos. 5,591,375, 5,422,026, 5,419,845, 5,387,360, 5,366,651, 5,352,408,5,330,670, and the like. The disclosure of each of these United States patents is hereby incorporated by reference into this specification.

In one embodiment, the antifreeze used is "PRESTONE" antifreeze, which is manufactured by the Union Carbide Company. This antifreeze is comprised of ethylene glycol.

One kilopascal is equal to 0.145 pounds per square inch. Thus, the 50 kilopascals vapor pressure produced, in a system not containing the heat expansion chamber, the glycol/water (coolant) mixture at 200 degrees Fahrenheit is equal to about 7.25 pounds per square inch, or 21.95 pounds per square inch absolute.

Figure 2:
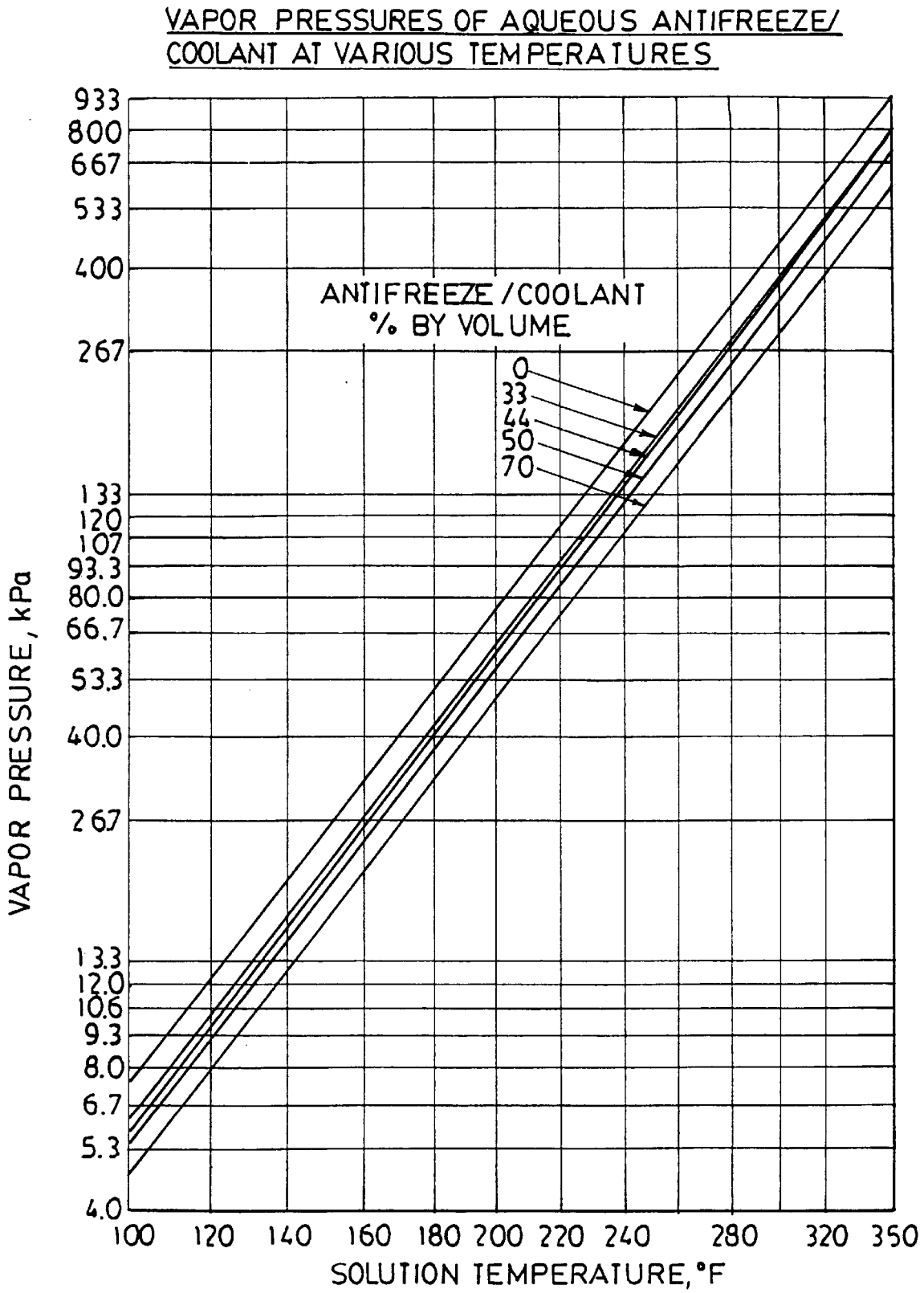
FIG. 2 is a chart showing how the vapor pressure of antifreeze/water mixtures varies with temperature.

The vapor pressures produced by various mixtures of water and "PRESTONE" antifreeze at different temperatures are shown in FIG. 2, which is a graph of pressure versus temperature. Mixtures of 0 volume percent, 33 volume percent, 44 volume percent, 50 volume percent, and 70 volume percent, with water, are illustrated. A temperature of 200 degrees Fahrenheit is not uncommon under normal driving conditions. At a temperature of about 200 degrees Fahrenheit, the vapor pressure generated by the 70%/30% glycol water mixture is about 50 kilopascals. However, under severe driving conditions, such as those encountered when driving up steep inclines, the temperature of the radiator often climbs above at least about 230 degrees Fahrenheit. At 230 degrees Fahrenheit, the vapor pressure of the 70%/30% glycol/water mixture is about 84 kilopascals, or about 12.18 pounds per square inch (gauge), or 26.98 pounds per square inch absolute. However, unexpectedly, with the apparatus depicted in FIG. 1, the pressure within the radiator generally does not exceed about 15.7 pounds per square inch absolute (1 psi gauge), even under severe driving conditions.

FIG. 2 is a graph showing the vapor pressure of a variety of mixtures of PRESTONE with water as a function of temperature obtained from the manufacturer.

Referring again to FIG. 1, it will be seen that heat expansion chamber 44 is disposed a distance 49 above the top 16 of radiator header 30. In general, distance 49 is at least about 0.5 inches, and preferably, at least about 1.0 inch. In one embodiment, the top 16 of radiator header 30 is substantially parallel to the bottom surface 51 of expansion chamber 44.

Heat expansion chamber 44 may be, e.g., any conventional heat expansion chamber known to those skilled in the art. Thus, e.g., one may use one or more of the expansion chambers disclosed in U.S. Pat. Nos. 5,433,577, 5,424,494, 5,409,514, 5,398,657, 5,390,995, 5,378,180, 5,376,341, 5,370,564, 5,351,483, 5,346,417, and the like. The disclosure of each of these United States patent is hereby incorporated by reference into this specification.

In one preferred embodiment, an optional safety relief valve 52 is connected to fitting 53 which, in the embodiment depicted, preferably has a diameter of from about 0.1 to about 0.3 inches.

The following examples are presented to illustrate the claimed invention but are not to be deemed limitative thereof. Unless otherwise stated, all parts are by weight and all temperatures are in degrees centigrade.

EXAMPLE 1

Figure 3:
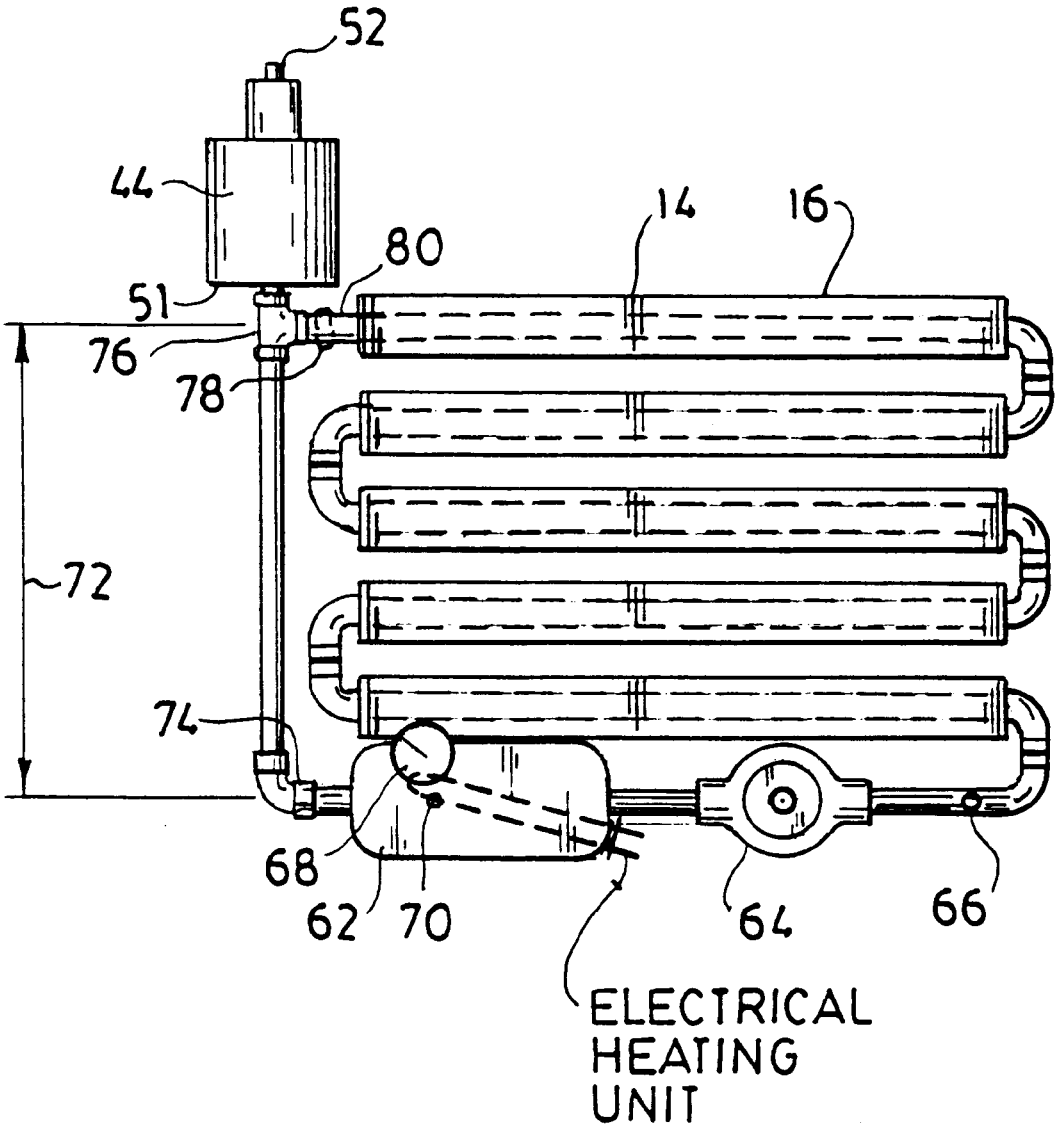
FIG. 3 is a schematic representation of a test apparatus described in this specification.

The experiment described in Example 1 was conducted at the Rochester Institute of Technology in Rochester, N.Y. by the Mechanical Engineering Department. The structure used in the experiment was substantially identical to the structure depicted in FIG. 3. Referring to FIG. 3, the heat expansion chamber 44 was made of tinned steel, had a cylindrical shape, and had a diameter of 4.25 inches and height of 5.0 inches. It was fitted with a "AUTO-VENT Automatic Air Eliminator" 52 (manufactured by Maid 0. Mist Company of Chicago, Ill.).

The bottom surface 51 of heat expansion chamber 44 was located 0.75 inches above the top surface 16 of the radiator. The radiator contained five interconnected tubes 14 with a length of about 25.121 inches. The fluid within the radiator was passed through electric heater 62 (which was equipped with a 208 volt, 1500 watt heater), circulating pump 64, and temperature sensor 66. A pressure sensor 68 and a thermocouple 70 was disposed within electric heater 62. The distance 72 between the heater inlet pipe 74 and the radiator outlet 76 was about 16.25 inches. A thermocouple 78 was clamped to outlet pipe 80, and it measured the temperature of the fluid exiting the top of the radiator.

The radiator was charged with a mixture of four parts by volume of PRESTONE and 1 part by volume of water; 19,867 grams of this fluid mixture were charged to the radiator.

After the test had been conducted for 10 minutes under these conditions, the temperature measured by thermocouple 70 was 248.1 degrees Fahrenheit, and the pressure was 0.8 p.s.i.g.; 19,867 grams of fluid remained in the system at this time. The system was run for 67 hours more, at a thermostat setting of 235.3 degrees Fahrenheit, as measured by thermocouple 70; the temperature in the heater measured by thermocouple 70 increased to 334 degrees Fahrenheit once during the total 77 hour period. At that time, the test was terminated. It was found that the system had lost 6 percent of the original mass of the fluid originally charged; however, the system pressure was 1.0 pound per square inch or less during the first 76 hours of the test.

Comparative Example 2

The procedure of the experiment of Example 1 was repeated with the same equipment, with the exception that the heat expansion chamber 44 and the relief valve were removed, and a plug was inserted in place of the heat expansion chamber 44. Under these conditions, the system pressure rose to 11.0 p.s.i.g. and the system temperature rose to 235.6 degrees Fahrenheit within 2 minutes.

The initial temperature measured under these conditions was 80 degrees Fahrenheit, and the initial pressure was 0 p.s.i.g. After 0.5 minutes, the temperature was 148.3 degrees Fahrenheit, and the pressure was 6 p.s.i.g. After 1.5 minutes, the temperature was 205.8 degrees Fahrenheit, and the pressure was 9.0 p.s.i.g. After 2.0 minutes, at which point the test was stopped, the temperature was 235.6 degrees Fahrenheit, and the pressure was 11.0 p.s.i.g.

EXAMPLE 3

The procedure of Example 1 was substantially followed with the same equipment, with the exception that the pressure relief valve 52 was removed from the expansion chamber 44 and replaced with a plug. The fluid used in the experiment contained 3 parts by volume of "PRESTONE", and one part by volume of water.

At 2.0 hours of test time, the fluid temperature in the heater was 250 degrees Fahrenheit, and the pressure was 0.5 p.s.i.g.

EXAMPLE 4

The procedure of Example 3 was substantially followed, with the exception that the heat expansion chamber 44 was removed from the system and replaced by a plug. At 11.0 minutes test time, the temperature in the heater was 200 degrees Fahrenheit, and the pressure was 12.0 p.s.i.g.

EXAMPLE 5

The procedure of Example 3 was substantially followed, with the exception that the distance between the bottom surface 51 of the heat expansion chamber 44 and the top surface 16 of the radiator was varied. At a temperature of 250 degrees Fahrenheit, and at distances of 0.75 inches, 2.0 inches, 3.0 inches, and 4.5 inches between the bottom surface 51 of the heat expansion chamber and the top surface 16 of the radiator, at 0.5 hours time the pressure in each of these experiments was 0.5 p.s.i.g.

When the plug on top of heat expansion chamber 44 was removed and replaced with a paper napkin, no gas flow was detected, i.e., the napkin stayed dry and was not moved out of place.

EXAMPLE 6

The procedure of Example 5 was substantially followed with the exception that the heat expansion chamber 44 was removed and replaced by a plug. At 10 minutes time, and at distances 49 of 0.75 inches, 2.0 inches, 3 inches, and 4.5 inches, the pressure was 12.0 p.s.i.g., and the temperature was 200 degrees Fahrenheit.

EXAMPLE 7

The procedure of Example 3 was substantially followed, with the exception that a 1500 watt quartz radiant heater was disposed about 8 inches away from the expansion chamber and used to heat such chamber. The exterior surface of the expansion chamber was coated with 200 degrees Fahrenheit heat resistant paint. After 3.0 hours of exposure to the radiant heater, and while the system's pump 64 and heater 62 were running at a heater temperature of 250 degrees Fahrenheit, the paint peeled from the exterior of the heat expansion chamber. However, in spite of this additional heat input, the pressure after 3.0 hours of test time was 0.5 p.s.i.g.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A process for reducing the pressure buildup in an automobile radiator which is comprised of a bottom section, a radiator header, a multiplicity of tubes communicating between said bottom section and said radiator header, and a heat expansion chamber disposed at least about 0.5 inches above said radiator header and connected to said radiator header by a conduit, comprising the steps of simultaneously:

(a) flowing hot fluid at a temperature of at least about 200 degrees Fahrenheit through said multiplicity of tubes, wherein said hot fluid is a mixture of water and ethylene glycol;

(b) preventing said hot fluid from flowing into said heat expansion chamber, wherein:

1. said heat expansion chamber is made from a material with a resistivity at 20 degrees Centigrade greater than about 6 microhms-centimeters, and
2. material within said heat expansion chamber has a resistivity at 20 degrees Centigrade of from about 6 to about 40 microhoms-centimeter; and (c) maintaining said hot fluid at a pressure of about 1.0 pound per square inch gauge or less.

2. The process as recited in claim 1, wherein said conduit has a substantially cylindrical shape.

3. The process as required in claim 2, wherein said conduit has an inner diameter of from about 0.1 to about 0.5 inches.

4. The process as recited in claim 1, wherein said heat expansion chamber has a substantially cylindrical shape.

5. The process as recited in claim 4, wherein the ratio of the diameter of said heat expansion chamber to its height is from about 0.8/1 to about 5.0/1.

6. The process as recited in claim 1, wherein said heat expansion chamber has a length of 14.5 inches, a height of 2.0 inches, and a width of 2.0 inches.

7. The process as recited in claim 1, wherein said heat expansion chamber has a volume which is from about 10 to about 20 percent of the volume of said hot fluid.

8. The process as recited in claim 1, wherein said heat expansion chamber is disposed at least 1.0 inches above said radiator header.

9. The process as recited in claim 8, wherein the bottom surface of said heat expansion chamber is substantially parallel to the top surface of said radiator header.

10. The process as recited in claim 1, wherein said heat expansion chamber is operatively connected to a pressure relief valve.

11. The process as recited in claim 10, wherein said pressure relief valve is connected to the top of said heat expansion chamber.

* * * * *